US010107242B2

(12) United States Patent
Sanftleben et al.

(10) Patent No.: US 10,107,242 B2
(45) Date of Patent: Oct. 23, 2018

(54) ACTUATING DRIVE FOR AN INJECTION VALVE, AND INJECTION VALVE

(71) Applicant: Continental Automotive GmbH, Hannover (DE)

(72) Inventors: Emanuel Sanftleben, Pfatter (DE); Martin Simmet, Bad Abbach (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 162 days.

(21) Appl. No.: 14/913,023

(22) PCT Filed: Aug. 21, 2014

(86) PCT No.: PCT/EP2014/067800
§ 371 (c)(1),
(2) Date: Feb. 19, 2016

(87) PCT Pub. No.: WO2015/024989
PCT Pub. Date: Feb. 26, 2015

(65) Prior Publication Data

US 2016/0201628 A1 Jul. 14, 2016

(30) Foreign Application Priority Data

Aug. 23, 2013 (DE) ..... 10 2013 216 836

(51) Int. Cl.
*F02M 51/00* (2006.01)
*F02M 51/06* (2006.01)
*F02M 61/16* (2006.01)

(52) U.S. Cl.
CPC ..... *F02M 51/005* (2013.01); *F02M 51/06* (2013.01); *F02M 61/168* (2013.01); *F02M 2200/9015* (2013.01)

(58) Field of Classification Search
CPC .... F02M 51/005; F02M 51/06; F02M 61/168; F02M 2200/9015
See application file for complete search history.

(56) References Cited

U.S. PATENT DOCUMENTS 4,030,668 A * 6/1977 Kiwior ..... F02M 51/005 239/568
4,101,074 A * 7/1978 Kiwior ..... F02M 51/005 239/585.4

(Continued)

FOREIGN PATENT DOCUMENTS

DE 4443004 A1 6/1995 ..... F02M 41/12
DE 102005025147 A1 12/2006 ..... F02M 51/06

(Continued)

OTHER PUBLICATIONS

International Search Report and Written Opinion, Application No. PCT/EP2014/067800, 18 pages, dated Dec. 2, 2014.

(Continued)

*Primary Examiner* — Sizo Vilakazi
*Assistant Examiner* — Sherman Manley
(74) *Attorney, Agent, or Firm* — Slayden Grubert Beard PLLC

(57) ABSTRACT

An actuating drive for an injection valve may comprise: a sleeve-shaped actuator housing; an actuator unit disposed in the housing; at least one actuator feed line; at least one connector contact; a housing unit; a cover; and a first sealing unit. The at least one actuator feed line may protrude from an end-side opening of the actuator housing. The at least one connector contact may be coupled electrically to the at least one actuator feed line and configured to be coupled electrically to a system-side connector. The housing unit may be arranged along a circumference of the actuator housing in an end-side shell surface section of the actuator housing and configured to fix the at least one connector contact in a (Continued)

predefined position. The cover may close a cavity defined by the housing unit and be coupled mechanically to the housing unit. The first sealing element may be arranged between the housing unit and the cover to prevent penetration of solid, liquid, or gaseous media into the cavity.

20 Claims, 4 Drawing Sheets

(56) References Cited

U.S. PATENT DOCUMENTS 4,944,486 A * 7/1990 Babitzka ..... F02M 51/0614 239/585.4
5,030,116 A * 7/1991 Sakai ..... F02M 51/005 123/456
5,059,857 A * 10/1991 Brandt ..... H01L 41/053 310/328
5,070,844 A * 12/1991 Daly ..... F02M 51/005 123/456
5,203,304 A * 4/1993 Hafner ..... F02M 51/005 123/456
5,244,180 A * 9/1993 Wakeman ..... F02M 51/0653 239/585.5
5,275,341 A * 1/1994 Romann ..... F02M 51/005 239/585.4
5,341,994 A * 8/1994 Wakeman ..... F02M 51/0653 239/585.3
5,350,314 A * 9/1994 Saba ..... F02M 51/005 123/470
5,381,965 A * 1/1995 Chabon ..... F02M 51/0646 239/585.1
5,476,079 A 12/1995 Kanamori et al. ..... 123/458
5,479,900 A * 1/1996 Bodenhausen ..... F02M 51/005 123/470
6,119,966 A * 9/2000 Wagner ..... F02M 47/027 239/585.1
6,332,453 B1 * 12/2001 Yamakado ..... F02D 41/20 123/490
6,834,844 B1 * 12/2004 Hamada ..... F02D 41/20 123/490
6,935,578 B1 * 8/2005 Shibata ..... B05B 1/3431 239/463
6,981,662 B2 * 1/2006 Luedicke ..... F02M 51/005 123/456
6,994,559 B1 * 2/2006 Sanftleben ..... F02M 51/005 439/130
7,175,105 B2 2/2007 Plecher et al. ..... 239/102.2
8,006,669 B2 * 8/2011 Unruh ..... F02M 51/005 123/470
8,656,766 B2 * 2/2014 Serizawa ..... F02M 51/005 73/114.51
2001/0025627 A1 * 10/2001 Lamb ..... F02M 35/10078 123/456
2004/0108395 A1 * 6/2004 Hamada ..... F02M 51/005 239/585.1
2006/0016418 A1 * 1/2006 Aoki ..... F02M 51/005 123/296
2006/0038030 A1 * 2/2006 Plecher ..... F02M 51/005 239/88
2006/0038031 A1 * 2/2006 Unruh ..... F02M 51/005 239/102.2
2006/0040537 A1 * 2/2006 Sanftleben ..... F02M 51/005 439/179
2006/0121767 A1 * 6/2006 Sanftleben ..... F02M 51/005 439/342
2006/0186767 A1 * 8/2006 Redding ..... F02M 51/005 310/365
2008/0163853 A1 * 7/2008 Bohlmann ..... F02M 51/005 123/472
2008/0197314 A1 * 8/2008 Bohlmann ..... F02M 61/168 251/366
2008/0237519 A1 * 10/2008 Sugiyama ..... F02M 51/005 251/129.15
2010/0245010 A1 * 9/2010 Sugiyama ..... F02M 51/005 336/192
2010/0263633 A1 * 10/2010 Kondo ..... F02M 47/027 123/478
2010/0294242 A1 * 11/2010 Kondo ..... F02M 47/027 123/470
2010/0313850 A1 * 12/2010 Kondo ..... F02M 47/027 123/445
2013/0270370 A1 * 10/2013 Kondo ..... F02M 51/0614 239/585.1

FOREIGN PATENT DOCUMENTS

DE 102008003210 A1 7/2008 ..... F16K 31/06
DE 102012102386 A1 10/2012 ..... F02D 41/00
EP 1577542 A1 9/2005 ..... F02M 47/02
EP 1628016 A1 2/2006 ..... F02M 51/00
WO 2005/066487 A1 7/2005 ..... F02M 61/16
WO 2015/024989 A1 2/2015 ..... F02M 51/00

OTHER PUBLICATIONS

German Office Action, Application No. 102013216836.5, 5 pages, dated Oct. 31, 2015.
Chinese Office Action, Application No. 201480058254.7, 15 pages, dated Sep. 13, 2017.

* cited by examiner

ACTUATING DRIVE FOR AN INJECTION VALVE, AND INJECTION VALVE

CROSS-REFERENCE TO RELATED APPLICATIONS

This application is a U.S. National Stage Application of International Application No. PCT/EP2014/067800 filed Aug. 21, 2014, which designates the United States of America, and claims priority to DE Application No. 10 2013 216 836.5 filed Aug. 23, 2013, the contents of which are hereby incorporated by reference in their entirety.

TECHNICAL FIELD

The disclosure generally relates to an actuator and, more specifically, to an actuating drive for an injection valve.

BACKGROUND

Valves, for example injection valves of an internal combustion engine of a motor vehicle, have an electrically controlled actuator unit which opens or closes the valve. The actuator unit may use electrical energy for actuating the actuator unit supplied from outside the valve body or housing.

In order to connect a electrical feed line to, for example, a piezoelectric actuator, a valve body is frequently encapsulated with a plastic in order to form a plug. Using various materials to encapsulate components with different coefficients of thermal expansion and/or different swelling behavior may create gaps between the component and the encapsulation which promote an ingress of liquid and may result under temperature loading and/or ingresses of moisture. As a result, the probability of a failure of the injection valve as a result of short circuit and/or accidental grounding increases considerably.

SUMMARY OF THE INVENTION

The present disclosure provides an actuating drive for an injection valve, and an injection valve, which can be produced simply and inexpensively and function reliably.

In some embodiments, the actuating drive for comprises a sleeve-shaped actuator housing with an actuator unit received therein and from which at least one actuator feed line protrudes from an end-side opening of the actuator housing. Furthermore, the actuating drive may include a connecting apparatus with at least one connector contact coupled electrically to the at least one actuator feed line and which can be coupled electrically to a system-side connector. Furthermore, the actuating drive may have a housing unit arranged at least along a circumference of the actuator housing in an end-side shell surface section of the actuator housing and is configured to fix the connecting apparatus in a predefined position. Furthermore, the actuating drive may comprise a cover closing a cavity defined by the housing unit, the cover coupled mechanically to the housing unit. Furthermore, the actuating drive may comprise a first sealing element arranged between the housing unit and the cover to prevent penetration of solid, liquid or gaseous media into the cavity.

Practicing the teachings of the present disclosure may provide a simple and inexpensive provision of the actuating drive with a sufficiently sealed, in particular sufficiently liquid-tight, plug for electrical contact of the injection valve. The housing unit may provide high mechanical stability and robustness. The medium-tight connection prevents undesired penetration of liquids into the actuating drive, as a result of which potential field failures of the injection valve as a result of short circuits and/or accidental groundings can be avoided. Susceptible and/or complex plug solutions produced by means of two-component (2C) injection molding can be avoided.

The arrangement of the first sealing element may prevent undesired media, in particular undesired liquids, from penetrating into the actuator housing and to the actuator unit. The first sealing element makes it possible, in particular, to seal a path between the housing part and the cover.

The respective cover may be produced independently of further components of the actuating drive. The cover can thus be utilized to distinguish various types of actuating drives by way of simple and satisfactory labeling and/or distinguishing features, for example by way of different colors.

The arrangement of the cover with the housing unit may allow arranging a semi-permeable sealing diaphragm in the cover or in the cavity in a simple way, which sealing diaphragm seals against liquids but ensures a gas exchange between a recess, in which the actuator unit is arranged, and its surroundings.

The housing unit and the actuator housing can be coupled, in particular connected, in a mechanically flexible manner.

In some embodiments, the cavity has a hollow-cylindrical configuration and the first sealing element is arranged along an inner wall which surrounds the hollow-cylindrical cavity.

In some embodiments, the actuating drive comprises a second sealing element arranged between an outer side of the actuator housing and an inner side of the housing unit, which inner side faces the direction of the actuator housing. This may prevent undesired media, in particular undesired liquids, from penetrating into the actuator housing and therefore arriving at the actuator unit. In such embodiments, the second sealing element seals a path between the actuator housing, which usually consists of steel or has steel, and the housing unit in a liquid-tight or gas-tight manner.

In some embodiments, the first sealing element and/or the second sealing element is a sealing ring. In particular, the respective sealing element may include an O-ring.

In some embodiments, the cover comprises a fixing element for the first sealing element. The fixing element may be arranged and configured to hold the first sealing element in a position which is spaced apart in a predefined manner from a side of the cover which is directed into the cavity. Such embodiments may provide a reliable, mechanically stable arrangement of the first sealing element.

In some embodiments, the actuator housing may include a projection along its circumference, and the second sealing element may be arranged on a side of the projection facing toward the end-side opening of the actuator housing. Such embodiments may provide a simpler arrangement of the second sealing element, improving the seal provided by the second sealing element.

In some embodiments, the cover comprises at least one latching hook configured to couple the cover mechanically to the housing unit. Such embodiments may offer improved reliable and stable mechanical coupling.

In some embodiments, the actuating drive comprises at least one third sealing element and a plug-in connector housing. The at least one connector contact of the connecting apparatus is arranged partially in the plug-in connector housing having a transition region, in which the at least one connector contact emerges from the plug-in connector housing for coupling to the system-side connector. The at least one third sealing element is arranged at least in the transition region. The third sealing element connects the at least one connector contact in a positively locking and/or medium-tight manner to the plug-in connector housing. Such embodiments may prevent penetration of media, in particular liquids, from the plug-in connector housing into the actuating drive.

In some embodiments, the actuating drive has at least one spiral clamping pin which couples the housing unit and the actuator housing mechanically. In such embodiments, the housing unit can be coupled to the actuator housing in a mechanically flexible manner. In particular, the housing unit and the actuator housing can be coupled mechanically in a manner which is dependent on a customer-specific arrangement of a high pressure and/or low pressure connector. In particular, a position of the housing unit along a circumference of the actuator housing can be selected in a manner which is dependent on a customer-specific arrangement of a high-pressure and/or low pressure connector. This flexibility may allow use in different customer-specific installation spaces.

In some embodiments, the housing unit and the plug-in connector housing are configured in one piece. Such embodiments may provide an inexpensive production of the actuating drive.

In some embodiments, an injection valve for an internal combustion engine of a motor vehicle for injecting fuel may include an actuating drive according to the first aspect.

BRIEF DESCRIPTION OF THE DRAWINGS

Exemplary embodiments of the invention are explained in the following text using the diagrammatic drawings, in which.

DETAILED DESCRIPTION

Elements of identical construction or function are provided with the same designations in all figures.

Figure 1:
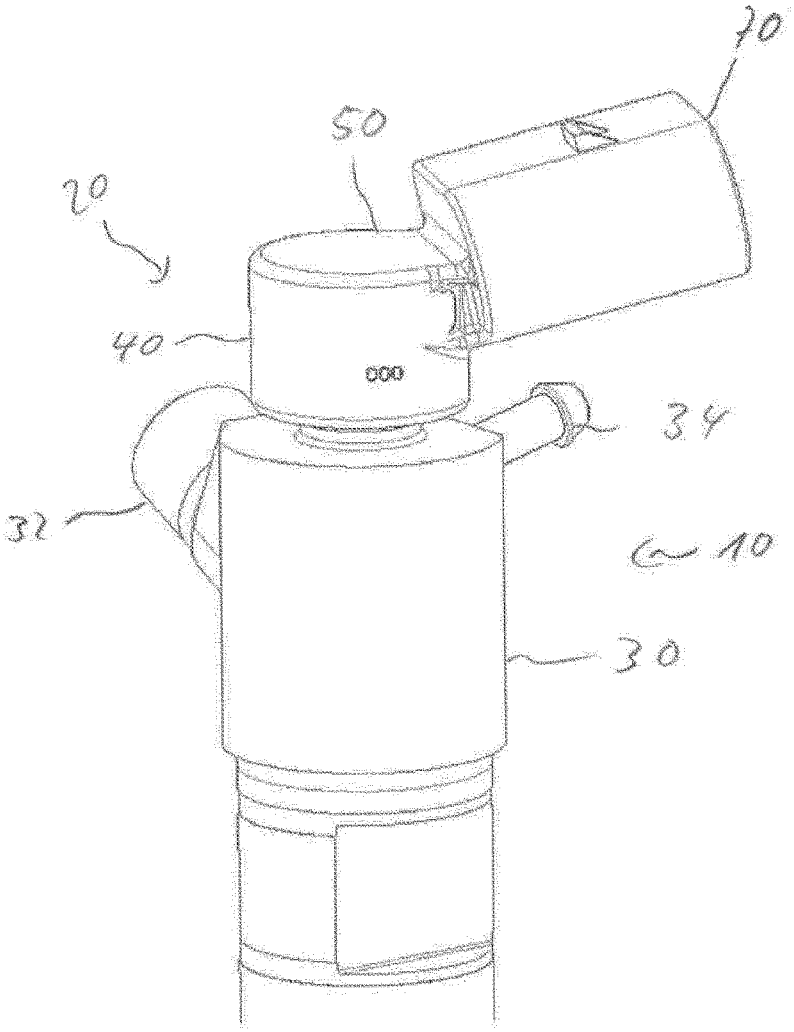
FIG. 1 shows an injection valve, according to teachings of the present disclosure.

FIG. 1 shows an exemplary injection valve 10. The injection valve 10 is configured, for example, for being arranged in an internal combustion engine of a motor vehicle for injecting fuel. The injection valve 10 comprises an actuating drive 20 with an actuator housing 30. The actuator housing 30 can also be called an actuator body. The injection valve 10 can comprise further bodies. Furthermore, the injection valve 10 comprises a fuel feed connector 32, via which fuel can be fed to the injection valve 10. Furthermore, the injection valve 10 comprises, for example, a leakage connector 34, via which excess fuel can be discharged from the injection valve 10.

The actuating drive 20 comprises, for example, a housing unit 40 and a plug-in connector, for example a VDA plug-in connector. A VDA plug-in connector is a plug specified by the Verband der Automobilindustrie e.V. (VDA) [German Association of the Automotive Industry].

Figure 2:
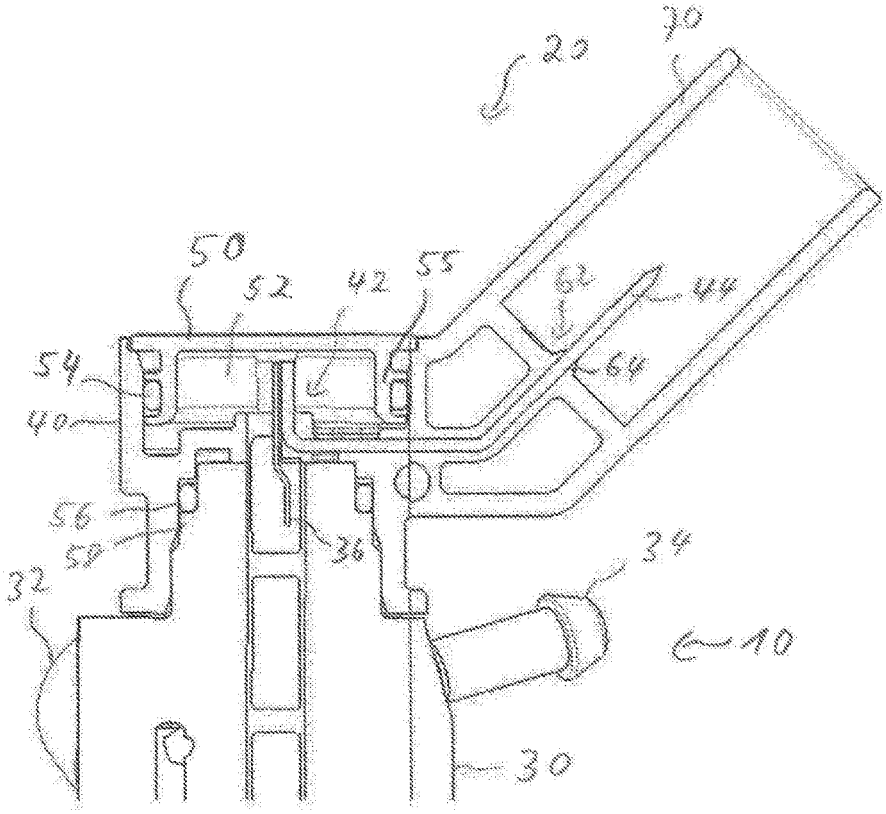
FIG. 2 shows a first sectional view of an actuating drive, according to teachings of the present disclosure.
Figure 3:
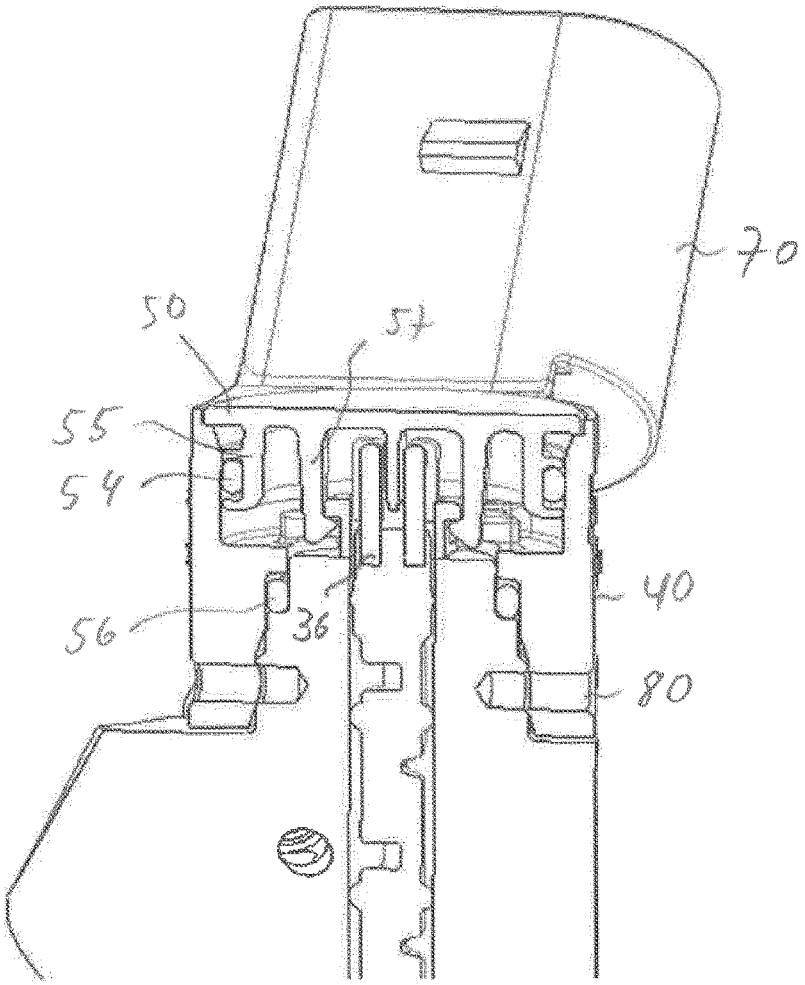
FIG. 3 shows a second sectional view of the actuating drive, according to teachings of the present disclosure.
Figure 4:
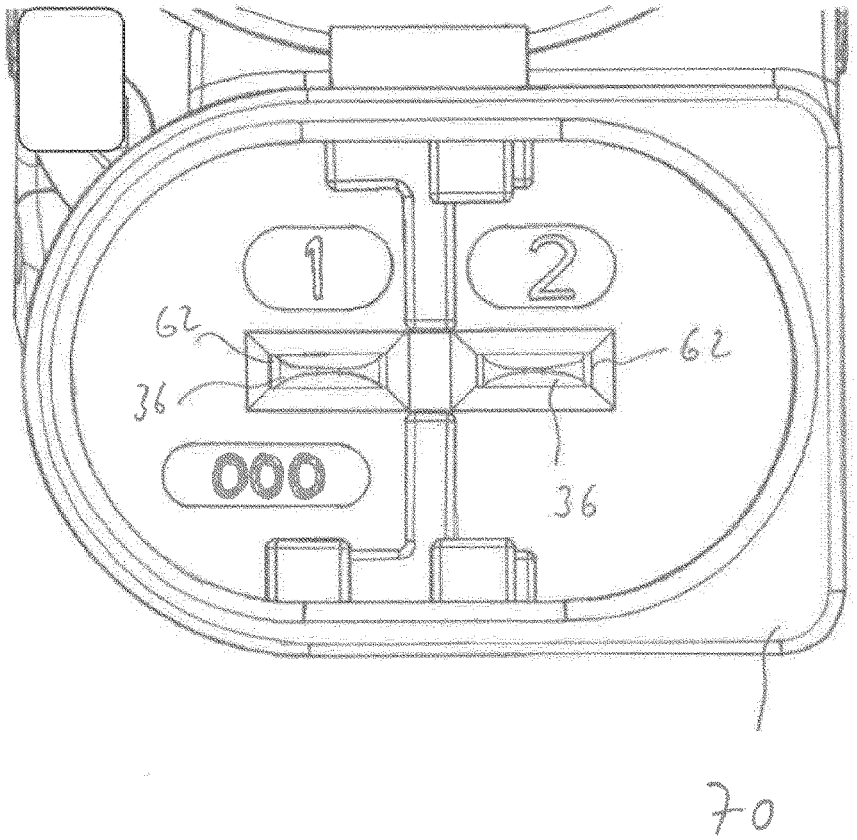
FIG. 4 shows a plug-in connector of the actuating drive according to teachings of the present disclosure.

FIG. 2 shows a cross section through a part of the actuating drive 20.

The actuator housing 30 of the actuating drive 20 is of sleeve-shaped configuration. A recess is configured in the actuator housing 30, with the result that the actuator housing 30 has an end-side opening. An actuator unit is arranged in the recess. At least one actuator feed line 36 protrudes out of the end-side opening of the actuator housing 30.

The actuator unit 10 comprises, for example, a piezoelectric actuator, but can also comprise any desired other actuator, for example a solenoid actuator. The actuator unit 10 can be supplied with electrical energy via the at least one actuator feed line 36. The actuator unit preferably has two actuator feed lines 36.

Furthermore, the actuating drive 20 comprises a connecting apparatus 42 with at least one connector contact 44 which is coupled electrically to the at least one actuator feed line 36 and can be coupled electrically to a system-side connector, in order to actuate the actuator unit in a desired way for injecting fuel.

The system-side connector can comprise, for example, a predefined plug-in connector of a control device and/or a connector line arrangement, for example the plug-in connector of a wiring harness in a motor vehicle.

Furthermore, the actuating drive 20 has a housing unit 40 which is arranged at least along a circumference of the actuator housing 30 in an end-side shell surface section of the actuator housing 30 and which is configured for fixing the connecting apparatus 42 in a predefined position. The housing unit 40 comprises, for example, a plastic and is produced, for example, by means of injection molding.

Furthermore, the actuating drive 20 comprises a cover 50 which closes a cavity 52 which is configured in the housing unit 40, the cover 50 being coupled mechanically to the housing unit 40.

The cover 50 comprises, for example, a fixing element 55 for a first sealing element 54, the fixing element 55 being arranged and configured to hold the first sealing element 54 in a position which is spaced apart in a predefined manner from a side of the cover 50 which is directed into the cavity 52.

The cover 50 comprises, for example, at least one latching hook 57 which is configured and arranged to couple the cover 50 mechanically to the housing unit 40.

The cover 50 is, for example, of substantially disk-shaped configuration. The cover 50 is preferably produced in one piece from plastic.

The first sealing element 54 is arranged or configured between the housing unit 40 and the cover 50 in such a way that it prevents a penetration of solid, liquid or gaseous media into the cavity 52.

The cavity 52 in the housing unit 40 is, for example, of hollow-cylindrical or substantially hollow-cylindrical configuration, and the first sealing element 54 is arranged along an inner wall which surrounds the hollow-cylindrical cavity 52. The first sealing element 54 is, for example, a sealing ring. In particular, the first sealing element 54 can be configured as an O-ring. The first sealing element 54 has, for example, fluorocarbon rubber (FKM) or consists of fluorocarbon rubber.

The actuating drive 20 preferably has a second sealing element 56 which is arranged between an outer side of the actuator housing 30 and an inner side of the housing unit 40, which inner side faces the actuator housing 30.

The actuator housing 30 has a projection 58, for example, along its circumference, and the second sealing element 56 is arranged on a side of the projection 58 which faces the end-side opening of the actuator housing 30. The projection 58 is configured, for example, as a collar.

The second sealing element 56 is, for example, likewise a sealing ring. In particular, the second sealing element 56 can be configured as an O-ring. The second sealing element 56 has, for example, fluorocarbon rubber (FKM) or consists of fluorocarbon rubber.

The actuating drive 20 comprises, for example, at least one third sealing element 64 and a plug-in connector housing 70. The at least one connector contact 44 of the connecting apparatus is arranged partially in the plug-in connector housing 70, the plug-in connector housing 70 having a transition region 62, in which the at least one connector contact 44 emerges from the plug-in connector housing 70 for coupling to the system-side connector. The at least one third sealing element 64 is arranged at least in the transition region 62. The third sealing element 64 connects the at least one connector contact 44 in a positively locking and/or medium-tight manner to the plug-in connector housing 70.

Here, medium-tight means at least liquid-tight. As an alternative, medium-tight can also mean liquid-tight and gas-tight.

For example, during the production of the actuating drive 20, the connector contact 44 of the connecting apparatus 42 is first of all sprayed and/or encapsulated with a sealing material in the predefined transition region 62 of the plug-in connector housing 70. Subsequently, the housing unit 40 is produced together with the plug-in connector, for example by means of injection molding, the at least one connector contact 44 of the connecting apparatus 42 being encapsulated in a suitable manner. Together with, for example, a molten plastic of the housing unit 40 and the plug-in connector housing 70, the sealing material forms the third sealing element 64 which connects the at least one connector contact 44 in a positively locking and/or medium-tight manner to the plug-in connector housing 70.

As an alternative, the housing unit 40 and the plug-in connector housing 70 can be produced independently of one another and can be connected mechanically to one another, for example, by means of welding.

The third sealing element 64 has, for example, fluorosilicone (FVMQ) or consists of fluorosilicone.

The housing unit 40 is placed, for example, onto the actuator housing 30 and is coupled mechanically to the actuator housing 30 by means of a spiral clamping pin 80 or a plurality of spiral clamping pins 80. As an alternative or in addition, further connecting techniques can be utilized for the mechanical coupling, such as screwing, welding, etc.

The connecting apparatus 42 has, for example, at least one electrical resistance. For example, the respective actuator feed lines 36 of a piezoelectric actuator are coupled via a high impedance electrical resistance, in order to dissipate charge states of the piezoelectric actuator on account of thermal changes and external actions of force in the non-operated state. The at least one resistance is arranged, for example, in the housing unit 40.

The respective at least one connector contact 44 is connected, for example, via a resistance weld to the associated at least one actuator feed line 36 of the actuator unit.

The invention claimed is:

1. An actuating drive for an injection valve, the drive comprising:

a sleeve-shaped actuator housing with an actuator unit disposed therein;

an actuator feed line protruding from a first end of the actuator housing into a cavity defined by a housing unit arranged at least along a circumference of the actuator housing, a connector contact coupled electrically to the actuator feed line within the cavity and configured to be coupled electrically to a system-side connector within the housing unit, the housing unit arranged along a circumference of the actuator housing in a shell surface section at the first end of the actuator housing and configured to fix the connector contact in a predefined position, a cover coupled mechanically to the housing unit to close the cavity without penetration by the actuator feed line or the connector contact, and a first sealing element forming a seal with both the housing unit and the cover to prevent penetration of solid, liquid or gaseous media into the cavity.

2. The actuating drive as claimed in claim 1, wherein the cavity has a hollow-cylindrical configuration and the first sealing element is arranged along an inner wall which surrounds the hollow-cylindrical cavity.

3. The actuating drive as claimed in claim 1, further comprising a second sealing element arranged between an outer side of the actuator housing and an inner side of the housing unit, and wherein the inner side faces in the direction of the actuator housing.

4. The actuating drive as claimed in claim 3, wherein the first sealing element and/or the second sealing element is a sealing ring.

5. The actuating drive as claimed in claim 1, wherein the cover is a fixing element for the first sealing element, the fixing element disposed to hold the first sealing element in a position spaced apart in a predefined manner from a side of the cover which faces into the cavity.

6. The actuating drive as claimed in claim 4, wherein the actuator housing has a projection along its circumference, and the second sealing element is arranged on a side of the projection which faces an opening in the first end of the actuator housing.

7. The actuating drive as claimed in claim 1, wherein the cover includes at least one latching hook configured to couple the cover mechanically to the housing unit.

8. The actuating drive as claimed in claim 1, further comprising:

a third sealing element, and a plug-in connector housing, wherein the connector contact is arranged at least partially within the plug-in connector housing, the plug-in connector housing including a transition region, in which the connector contact emerges from the plug-in connector housing for coupling to the system-side connector, and the third sealing element arranged at least partially in the transition region, the third sealing element connecting the connector contact in a positively locking or medium-tight manner to the plug-in connector housing.

9. The actuating drive as claimed in claim 1, further comprising a spiral clamping pin coupling the housing unit and the actuator housing mechanically.

10. The actuating drive as claimed in claim 1, wherein the housing unit and the plug-in connector housing are formed integrally in one piece.

11. An injection valve for an internal combustion engine of a motor vehicle for injecting fuel, comprising:

a nozzle for dispensing fuel into a chamber of the internal combustion engine;

a needle for alternatively blocking and allowing fuel flow through the nozzle;

an actuator moving the nozzle between a closed and an open position;

a sleeve-shaped actuator housing with an actuator unit disposed therein;

an actuator feed line protruding from a first end of the actuator housing into a cavity defined by a housing unit, a connector contact coupled electrically to the actuator feed line within the cavity and configured to be coupled electrically to a system-side connector within the housing unit, the housing unit arranged along a circumference of the actuator housing in a shell surface section at the first end of the actuator housing and configured to fix the connector contact in a predefined position, a cover coupled mechanically to the housing unit to close the cavity without penetration by the actuator feed line or the connector contact, and a first sealing element forming a seal with both the housing unit and the cover to prevent penetration of solid, liquid or gaseous media into the cavity.

12. The injection valve as claimed in claim 11, wherein the cavity has a hollow-cylindrical configuration and the first sealing element is arranged along an inner wall which surrounds the hollow-cylindrical cavity.

13. The injection valve as claimed in claim 11, further comprising a second sealing element arranged between an outer side of the actuator housing and an inner side of the housing unit, and wherein the inner side faces in the direction of the actuator housing.

14. The injection valve as claimed in claim 13, wherein the first sealing element and/or the second sealing element is a sealing ring.

15. The injection valve as claimed in claim 11, wherein the cover is a fixing element for the first sealing element, the fixing element disposed to hold the first sealing element in a position spaced apart in a predefined manner from a side of the cover which faces into the cavity.

16. The injection valve as claimed in claim 14, wherein the actuator housing has a projection along its circumference, and the second sealing element is arranged on a side of the projection which faces the end-side opening of the actuator housing.

17. The injection valve as claimed in claim 11, wherein the cover includes a latching hook configured to couple the cover mechanically to the housing unit.

18. The injection valve as claimed in claim 11, further comprising:

a third sealing element, and a plug-in connector housing, wherein the connector contact is arranged at least partially within the plug-in connector housing, the plug-in connector housing including a transition region, in which the connector contact emerges from the plug-in connector housing for coupling to the system-side connector, and the third sealing element arranged at least partially in the transition region, the third sealing element connecting the connector contact in a positively locking or medium-tight manner to the plug-in connector housing.

19. The injection valve as claimed in claim 11, further comprising a spiral clamping pin coupling the housing unit and the actuator housing mechanically.

20. The injection valve as claimed in claim 11, wherein the housing unit and the plug-in connector housing are formed integrally in one piece.

* * * * *